US010105744B2

(12) United States Patent
Kim et al.

(10) Patent No.: US 10,105,744 B2
(45) Date of Patent: Oct. 23, 2018

(54) PRESS DIE FOR ELECTRICALLY ASSISTED MANUFACTURING

(71) Applicants: MS AUTOTECH CO., LTD, Gyeongsangbuk-do (KR); Kyung-Sik Kim, Ulsan (KR); Ulsan Technopark, Ulsan (KR)

(72) Inventors: Jang-Soo Kim, Gyeonggi-do (KR); Dae-Ho Yang, Gyeonggi-do (KR); Hong-Kyo Jin, Gyeonggi-do (KR); Kyung-Sik Kim, Ulsan (KR); Dong-Keun Kweon, Ulsan (KR); Sang-Woo So, Gyeongsangnam-do (KR); Hyun-Tae Hwang, Ulsan (KR)

(73) Assignees: MS AUTOTECH CO., LTD, Gyeongsangbuk-Do (KR); Kyung-Sik Kim, Ulsan (KR); ULSAN TECHNOPARK, Ulsan (KR)

( * ) Notice: Subject to any disclaimer, the term of this patent is extended or adjusted under 35 U.S.C. 154(b) by 487 days.

(21) Appl. No.: 14/287,084

(22) Filed: May 26, 2014

(65) Prior Publication Data

US 2015/0183019 A1 Jul. 2, 2015

(30) Foreign Application Priority Data

Dec. 31, 2013 (KR) ..... 10-2013-0168468
Dec. 31, 2013 (KR) ..... 10-2013-0168469

(51) Int. Cl.
*B21D 37/16* (2006.01)
*H05B 3/00* (2006.01)
(Continued)

(52) U.S. Cl.
CPC ..... *B21D 37/16* (2013.01); *B21D 22/208* (2013.01); *H05B 3/0004* (2013.01); *B21D 24/16* (2013.01); *B30B 15/34* (2013.01)

(58) Field of Classification Search
CPC ..... B21D 24/02; B21D 24/16; B21D 26/12; B21D 37/16; B21D 22/208; B21D 43/28; B30B 15/08; B30B 15/34; H05B 3/0004
See application file for complete search history.

(56) References Cited

U.S. PATENT DOCUMENTS 1,112,774 A * 10/1914 Forsyth ..... A45B 25/08 135/40
2,443,336 A * 6/1948 Waldie ..... B21D 24/16 219/154

(Continued)

FOREIGN PATENT DOCUMENTS

CN 101934338 B * 7/2012
JP 2008068282 A * 3/2008
KR 20130076486 A 7/2013

OTHER PUBLICATIONS

Roth, J.T., Loker, I., Mauck, D., Warner, M., Golovashchenko, S.F., Krause, A.: "Enhanced formability of 5754 aluminum sheet metal using electric pulsing", pp. 405-412.

*Primary Examiner* — Teresa M Ekiert
*Assistant Examiner* — Gregory Swiatocha
(74) *Attorney, Agent, or Firm* — Gokalp Bayramoglu

(57) ABSTRACT

The invention discloses a press die for electrically assisted manufacturing performing plastic working at a relatively lower temperature than hot working by using an electro-plasticity effect that a flow stress inside a material is reduced when a current is applied to the material, the press die for electrically assisted manufacturing including: an upper die and a lower die configured to be disposed at upper and lower portions, having the material disposed therebetween; and at least one electrode pair configured to be disposed in the upper die or the lower die, wherein the electrode pair is configured so that electrodes having different polarities in a width direction of the material face each other.

6 Claims, 7 Drawing Sheets

(51) Int. Cl.

| | |
|---|---|
| ***B21D 22/20*** | (2006.01) |
| ***B21D 24/16*** | (2006.01) |
| ***B30B 15/34*** | (2006.01) |

(56) References Cited

U.S. PATENT DOCUMENTS

| | | | | |
|---|---|---|---|---|
| 5,331,832 | A * | 7/1994 | Cherian | B21D 26/14 72/430 |
| 7,302,821 | B1 * | 12/2007 | Dariavach | B21D 5/04 219/152 |
| 2008/0257007 | A1 * | 10/2008 | Golovashchenko | B21D 26/06 72/342.96 |
| 2012/0055217 | A1 * | 3/2012 | Roth | B21D 31/005 72/54 |
| 2014/0150514 | A1 * | 6/2014 | Wang | B21D 39/023 72/252.5 |

* cited by examiner

PRESS DIE FOR ELECTRICALLY ASSISTED MANUFACTURING

CROSS-REFERENCE TO RELATED APPLICATION(S)

This application claims priority to Korean Patent Application Nos. 10-2013-0168468 and 10-2013-0168469, filed on Dec. 31, 2013, the disclosures of which are incorporated herein by reference in their entirety.

BACKGROUND OF THE INVENTION

Field of the Invention

Exemplary embodiments of the present invention relate to a press die, and more particularly, to a press die for electrically assisted manufacturing which is used to work a material using an electroplasticity effect.

Description of the Related Art

Recently, an automobile industry has focused on a lightweight so as to improve fuel efficiency and tends to use ultra high strength car body parts so as to secure sufficient rigidity.

That is, to form products having a relatively smaller weight and higher rigidity, a tendency to fold the products using a higher strength material has increased.

However, the ultra high strength material has strength much higher than that of a general steel alloy or aluminum alloy and has limited formability under normal environment and therefore is hardly used in the industry.

Therefore, research to improve the formability of the ultra high strength material has been continued, and in this case, and example of a typical method may include hot forming, warm forming, and the like which work metals at high temperature. However, these methods involves essential problems, such as a change in physical properties of a material, adhesion between a die and the material, a difficulty in lubrication, and time consumption required for heating and cooling, due to the material subjected to high temperature environment.

Recently, instead of the hot forming and the warm forming, technologies such as hydro forming and incremental forming capable of supplementing the aforementioned defects while promoting improvement in formability have been attempted. However, these state-of-the art technologies have variously technical advantages, but are not yet completely satisfactory. The main reason is that initial cost of manufacturing equipments is high and it takes much time for a manufacturing process.

Therefore, a new method for improving the formability of the ultra high strength material is required and unlike the typical hot forming or warm forming, need not use an effect of increasing the temperature of the material as a main principle and consume huge costs for installing the manufacturing equipments for the manufacturing process.

FIG. 1 is a curve diagram of stress-strain of stainless steel depending on a current density at the time of electric conduction.

Recently, as illustrated in FIG. 1, when a current is applied while a metal material is deformed by an external force, an electrically assisted manufacturing (EAM) technology using the effect (electroplasticity effect) that a flow stress inside the metal material is reduced and thus plastic working may be made by a smaller force has been researched.

Although this research does not completely describe the principle of the electroplasticity effect, it is to be noted that the electroplasticity effect may not be described as an effect depending on heating and temperature rising, considering the fact that the flow stress is greatly reduced within a melting point of the material at the time of the electrically assisted manufacturing and temperature which does not reach hot working temperature (see Non-Patent Document 1).

Further, Korean Patent Laid-Open Publication No. 10-2013-0076486 (Patent Document 1) which is prior application of the present applicant discloses an apparatus and a method for performing a trim in a state in which rigidity of high strength parts is instantly weakened using an electroplasticity effect.

However, the related art confirms only the electroplasticity effect by applying a current to a material in a laboratory scale and does not specifically mention an assembling structure of a die and an electrode or an electrode disposition structure of the die so as to maximize formability of a material by applying the electrically assisted manufacturing to a production process of actual products.

Meanwhile, as the die of a metal material or a working tool contacts the material at the time of forming the products using the electroplasticity effect, a supplied current may be leaked to the die or the working tool through the material.

As described above, when the current supplied to the material is leaked to the die or the working tool, a current distribution, such as a current density of the material, is changed, such that a quality of the formed products may not be insured or it is difficult to obtain a desired forming load. Further, manufacturing cost may be increased due to wasted energy and the failure of equipment or the electric shock accident may occur due to the leakage current.

RELATED ART DOCUMENT

Patent Document (Patent Document 1) KR10-2013-0076486A (Published on Jul. 8, 2013)

Non-Patent Document (Non-Patent Document 1) Roth, J. T., Loker, I., Mauck, D., Warner, M., Golovashchenko. S. F., Krause, A., 2008. Enhanced formability of 5754 aluminum sheet metal using electric pulsing. Trans. NAMRI/SME 36, 405-412.

SUMMARY OF THE INVENTION

An object of the present invention is to provide a press die for electrically assisted manufacturing which includes an electrode for electrically assisted manufacturing to be able to prevent a current from leaking to a die or a working tool from a material at the time of the electrically assisted manufacturing.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a press die for electrically assisted manufacturing performing plastic working at a relatively lower temperature than hot working by using an electroplasticity effect that a flow stress inside a material is reduced when a current is applied to the material, the press die for electrically assisted manufacturing includes: an upper die and a lower die configured to be disposed at upper and lower portions, having the material disposed therebetween; and at least one electrode pair configured to be disposed in the upper die or the lower die, wherein the electrode pair is configured so that electrodes having different polarities in a width direction of the material face each other.

In the press die for electrically assisted manufacturing in accordance with one aspect of the present invention, the upper die and the lower die may be each provided with the electrode pairs, the upper die and the lower die may be provided with the electrodes having first polarity along one edge in the width direction of the material, and the upper die and the lower die may be provided with the electrodes having second polarity along the other edge in the width direction of the material.

In the press die for electrically assisted manufacturing in accordance with one aspect of the present invention, the upper die and the lower die may be each provided with the electrode pairs, the lower die may be provided with the electrode having the first polarity along one edge of the material, and the upper die may be provided with the electrode having the second polarity along the other edge of the material.

In the press die for electrically assisted manufacturing in accordance with one aspect of the present invention, the electrode pairs may be disposed to be concentrated at a stress concentration portion of the material.

In accordance with another aspect of the present invention, a press die for electrically assisted manufacturing performing forming at a relatively lower temperature than hot working by using an electroplasticity effect that a flow stress inside a material is reduced when a current is applied to the material, the press die for electrically assisted manufacturing includes: an upper die and a lower die configured to be disposed at upper and lower portions, having the material disposed therebetween; and at least one electrode pair configured to be disposed in the upper die or the lower die, wherein the electrode pair is configured so that electrodes having the same polarity in a width direction of the material face each other.

In the press die for electrically assisted manufacturing in accordance with another aspect of the present invention, one side of the upper die or the lower die may be provided with electrodes having polarity different from the electrode pairs to be disposed between the electrode pairs.

In the press die for electrically assisted manufacturing in accordance with another aspect of the present invention, a distances between the electrodes having different polarities in the width direction of the material may be equal to that between the electrode pairs and the electrodes having different polarities may be disposed to correspond to a material area having a strain larger than that of the circumference at the time of forming.

In the press die for electrically assisted manufacturing in accordance with another aspect of the present invention, the lower die may be provided with the electrode having first polarity along both edges of the material, and the lower die may be provided with the electrode having a second polarity along a central portion of the material.

In the press die for electrically assisted manufacturing in accordance with another aspect of the present invention, the upper die may be provided with the electrode having the first polarity along both edges of the material and the upper die may be provided with the electrode having the second polarity along a central portion of the material.

In the press die for electrically assisted manufacturing in accordance with another aspect of the present invention, the upper die may be provided with the electrode having the first polarity along both edges of the material and the lower die may be provided with the electrode having the second polarity along a central portion of the material.

In the press die for electrically assisted manufacturing in accordance with another aspect of the present invention, the lower die may be provided with the electrode having the first polarity along both edges of the material and the upper die may be provided with the electrode having the second polarity along a central portion of the material.

In the press die for electrically assisted manufacturing in accordance with another aspect of the present invention, the upper die and the lower die may be each provided with the electrode pairs, the upper die may be provided with an electrode having first polarity along both edges in a width direction of the material, and the lower die may be provided with an electrode having second polarity facing the electrode having the first polarity along both edges in the width direction of the material.

In the press die for electrically assisted manufacturing in accordance with another aspect of the present invention, the press die for electrically assisted manufacturing may further include: a trim cutter configured to be disposed in the upper die and cut both edges in the width direction of the material.

In the press die for electrically assisted manufacturing in accordance with another aspect of the present invention, at least one electrode pair may be disposed to be spaced apart from each other along a length direction of the material.

In the press die for electrically assisted manufacturing in accordance with another aspect of the present invention, currents supplied to the electrodes forming the electrode pair may be individually controlled.

In the press die for electrically assisted manufacturing in accordance with another aspect of the present invention, the electrode adjacent to a stress concentration part of the material may be supplied with electric energy larger than that supplied to other electrodes.

In the press die for electrically assisted manufacturing in accordance with another aspect of the present invention, the electrode adjacent to the stress concentration part of the material may be applied with a higher-density current than that applied to other electrodes.

In the press die for electrically assisted manufacturing in accordance with another aspect of the present invention, the electrode adjacent to the stress concentration part of the material may be applied with a current for a longer period of time than other electrodes.

In the press die for electrically assisted manufacturing in accordance with another aspect of the present invention, in the upper die or the lower die, a contact area with the material may be provided with an insulating coating part.

In the press die for electrically assisted manufacturing in accordance with another aspect of the present invention, the insulating coating part may be detachably coupled with the upper die or the lower die.

In the press die for electrically assisted manufacturing in accordance with another aspect of the present invention, the electrode may be detachably coupled with the insulating coating part which is formed in the upper die or the lower die.

In the press die for electrically assisted manufacturing in accordance with another aspect of the present invention, the lower die may be configured to include a blank holder seated with the material and a punch having one end elevately disposed to penetrate through the blank holder.

In the press die for electrically assisted manufacturing in accordance with another aspect of the present invention, the insulating coating part may be configured to include a first coating part disposed at one side of the blank holder, a second insulating coating part disposed at one side of the upper die, and a third insulating coating part disposed at an upper end of the punch.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
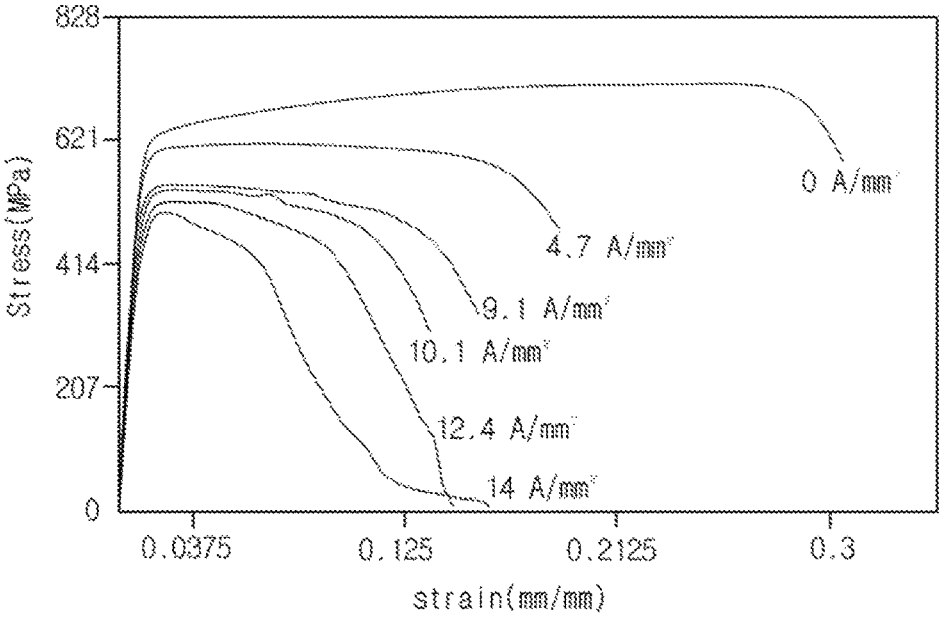
FIG. 1 is a curve diagram of stress-strain of stainless steel depending on a current density at the time of electric conduction.

Hereinafter, a press die for electrically assisted manufacturing in accordance with exemplary embodiments of the present invention will be described with reference to the accompanying drawings. During the process, a thickness of lines, a size of components, or the like, illustrated in the drawings may be exaggeratedly illustrated for clearness and convenience of explanation.

Further, the following terminologies are defined in consideration of the functions in the present invention and may be construed in different ways by intention or practice of users and operators. Therefore, the definitions of terms used in the present description should be construed based on the contents throughout the specification.

In addition, the following embodiments are not limited to the scope of the present invention but illustrate only the components included in the claims of the present invention and it will be appreciated that embodiments including components which are included in the spirit of the specification of the present invention and may be substituted into equivalents in the components of the claims may be included in the scope of the present invention.

First Embodiment

Figure 2:
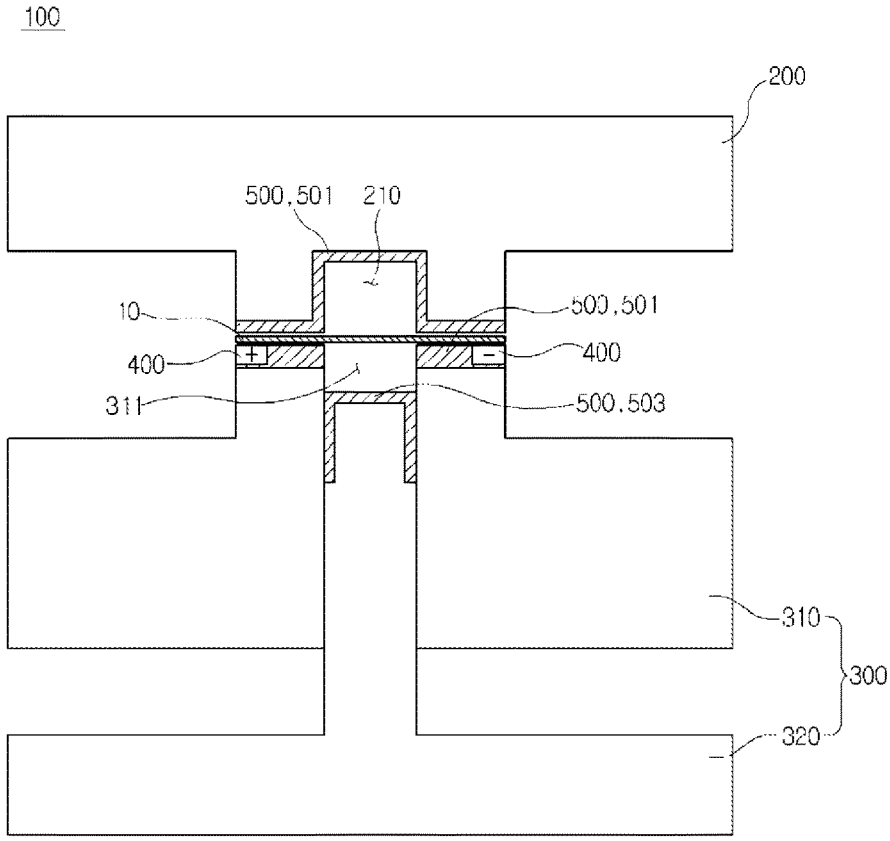
FIG. 2 is a schematic diagram of a press die for electrically assisted manufacturing in accordance with a first embodiment of the present invention.
Figure 3:
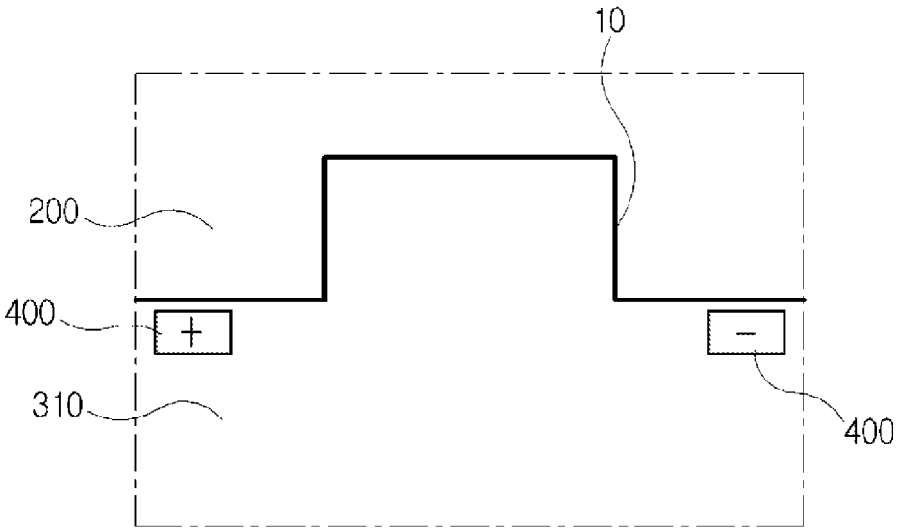
FIG. 3 is a schematic diagram illustrating a disposition structure of an electrode in accordance with the first embodiment of the present invention.

FIG. 2 is a schematic diagram of a press die for electrically assisted manufacturing in accordance with a first embodiment of the present invention and FIG. 3 is a schematic diagram illustrating a disposition structure of an electrode in accordance with the first embodiment of the present invention, in which for convenience of explanation, only relative positions of a material and electrode pairs are illustrated.

As illustrated in FIG. 2, a press die for electrically assisted manufacturing in accordance with a first embodiment of the present invention includes an upper die 200 and a lower die 300 disposed at upper and lower portions, having a material disposed therebetween.

In this case, the upper die 200 and the lower die 300 have a shape corresponding to a shape of a final product so that they may relatively move to each other to press a material 10 so as to be formed in a desired shape and a configuration of the upper die 200 and the lower die 300 may be variously selected if necessary.

For example, in the case of intending to form a product having a form that a central portion of the material 10 protrudes than both edges of the material 10, as illustrated in FIG. 2, the lower die 300 may be configured to include a blank holder 310 which supports the material 10 and has a center provided with a guide hole 311 and a punch 320 which is disposed under the blank holder 310 and presses the material 10 through the guide hole 311. In this configuration, the upper die 200 is disposed above the blank holder 310 to press upper sides of the material 10 and is provided with a depressed part 210 corresponding to the guide hole 311.

As another example, a central portion of the lower die 300 which supports the material 10 may be provided with the depressed part (not illustrated), a central portion of the upper die 200 which moves downwardly to press and deform the material 10 may be provided with a protruding portion (not illustrated), and both sides of the upper mold 200 may be elastically provided with a pressing pad (not illustrated) to press and fix the both edges of the material 10 at the time of press forming.

In accordance with the first embodiment of the present invention, as illustrated in FIG. 2, the blank holder 310 may be provided with at least one electrode pair.

The electrode pair is to apply a current to the material 10 at the time of electrically assisted manufacturing, in which the "electrically assisted manufacturing" means that plastic working is made with a forming load lower than that of cold working by using an electroplasticity effect that a flow stress inside the material 10 is reduced when a current is applied to the material 10.

That is, at the time of the electrically assisted manufacturing, a temperature of the material may rise to some extent due to resistance heat which is generated by the current applied to the material 10 but does not reach temperature required for heat treatment, hot forming, or warm forming. Therefore, the 'normal temperature' in the present specification indicates temperature relatively lower than the heat treatment temperature, the hot forming temperature, or the warm forming temperature which is different for each kind of the material 10.

For example, hot stamping temperature of steel is 930° C. or more and in the case of hot forming, the hot forming temperature rises to 600 to 900° C. by ambient heating, while heat generation temperature is less than 300° C. at the time of electrically assisted manufacturing.

Further, at the time of the hot forming of aluminum, the temperature is 200 to 300° C., while at the time of the electrically assisted manufacturing, the temperature is less than 200° C., and the hot forming temperature of magnesium alloy is 300 to 400° C., while at the time of the electrically assisted manufacturing, the temperature is less than 200° C.

The electrode pairs disposed in the blank hold 310 are formed so that electrodes 400 having different polarities are disposed to face each other in a width direction of the material 10, in which at least one electrode pair may be disposed, spaced apart from each other in a length direction of the material 10.

In this case, the electrode 400 which is disposed in the blank holder 310 along one edge in the length direction of the material 10 may be the electrode 400 having the same polarity. For example, in the case of the embodiment of the present invention illustrated in FIGS. 2 and 3, the electrodes 400 having (+) polarity are disposed at a left edge of the material 10 and the electrodes 400 having (−) polarity are disposed along a right edge of the material 10.

Here, when the material 10 is formed by the press operation, a current is applied crossing a width direction of the material 10 to be applied to the entire area of the material 10 and in accordance with the embodiment of the present invention illustrated in FIGS. 2 and 3, a current is applied from the (+) electrode 400 disposed at the left edge of the material 10 to the (−) electrode 400 disposed at the right edge of the material 10.

Unlike this, when the electrodes 400 having different polarities are disposed along one edge in the length direction of the material 10, a current is not applied to the other electrode 400, crossing the width direction of the material 10 and is applied in a direction of an adjacent electrode 400 having different polarity, such that the current may not be applied to the entire area of the material 10 and a current density may be non-uniformly distributed.

As the material 10 approaches the electrode 400, the current density is high, such that the electrode 400 is adjacently disposed to a portion at which a stress is concentrated in the material 10, that is, a portion at which cracks or wrinkles are expected to be generated at the time of press forming.

As another example, the electrode 400 adjacently disposed to a stress concentration portion of the material 10 may be applied with a current larger than that applied to the other electrode 400 or may be applied with a larger current for a longer period of time.

That is, the electrode 400 adjacently disposed to the stress concentration portion of the material 10 may be supplied with larger electric energy. To this end, each electrode 400 may be controlled to be applied with a current by a controller (not illustrated) which is disposed between a power supply apparatus (not illustrated) and the electrode 400.

In this case, the current applied to the material 10 may be a pulse current having a predetermined duration and a pulse period and a form of the pulse current may be controlled by a separate controller (not illustrated) which is disposed between the power supply apparatus and the electrode 400.

The material 10 may be continuously applied with a current; however, to prevent heat from generating due to a specific resistance of the material 10 itself, save energy, and maximize formability thanks to an electroplasticity effect, it is preferable to use a pulse current which may apply large electric energy for a short period of time.

Meanwhile, to prevent the current applied to the material 10 from leaking through the die 100, the die 100 area is provided with an insulating coating part 500 of which the surface is coated with an insulating coating material and the electrode 400 may be disposed so that a circumference of the electrode 400 is enclosed with the insulating coating part 500.

In this case, when the insulating coating part 500 and the electrode 400 are damaged, to make the maintenance of the insulating coating part 500 and the electrode 400 easy, the insulating coating part 500 may be detachably coupled with the die 100 as a separate component and the electrode may be detachably coupled with the insulating coating part 500 so that the insulating coating part 500 may be easily replaced according to the occurrence of failure or damage or the change in application of current. Herein, instead of the surface coated insulating coating part 500, a separate insulating member may be coupled with the die 100.

The insulating coating part 500 is formed in the contact area with the material 10 in the upper die 200 or the lower die 300. For example, as illustrated in FIG. 2, the insulating coating part 500 is configured to include a first insulating coating part 501 which is disposed at one side of the blank holder 310, a second insulating coating part 502 which is disposed at one side of the upper die 200, and a third insulating coating part 503 which is disposed at an upper end of the punch 320.

The first insulating coating part 501 may be coated on an upper end surface of the blank holder 310 and may also be separately manufactured to be detachably coupled with the blank holder 310. In the case in which the first insulating coating part 501 is detachably coupled with the blank holder 310, the first insulating coating part 501 may be easily replaced when the surface of the first insulating coating part 501 is damaged and the time and cost required for the maintenance of the first insulating coating part 501 may be saved.

As the coating material, diamond like carbon (DLC), teflon, and silica ($SiO_2$) may be used, and preferably, after the first insulating coating part 501 is subjected to heat treatment and nitriding treatment to improve surface hardness, the first insulating coating part 501 is coated with the DLC.

The second insulating coating part 502 may be formed by surface-coating a lower end of the upper die 200 with the insulating coating material, and preferably, is separately manufactured to be detachably coupled with the upper die 200.

The third insulating coating part 503 may be formed by surface-coating an upper end of the punch 400 with the insulating coating material, and preferably, is separately manufactured to be detachably coupled with the punch 320.

When the material 10 is press-worked using the die 100 as described above, the material 10 is subjected to the electroplasticity press working as follows.

First, the material 10 is seated in the blank holder 310 and power is supplied from an external power supply apparatus to the electrode 400. In this case, the current density, the applied time, or the like of the pulse current or the continuous current applied from the electrode 400 to the material may be controlled by the controller.

At the time of applying a current from the electrode 400 to the material 10, the flow stress inside the material 10 is reduced at the normal temperature due to the electroplasticity effect.

The upper die 200 and the punch 320 are elevated in the direction of the blank holder 310 by the press operation in the state in which the flow stress inside the material 10 is reduced while a current is applied or immediately after a current is applied and thus the material 10 is formed in a form of a product by pressing force.

In this case, the forming load is much smaller than that at the time of the cold forming of the material 10 and in the embodiment of the present invention, it is already described that a current is not supplied to increase the temperature of the material 10 to temperature required in the normal hot forming or warm forming due to the generation of resistance heat but is applied to generate the electroplasticity effect.

Second Embodiment

Figure 4:
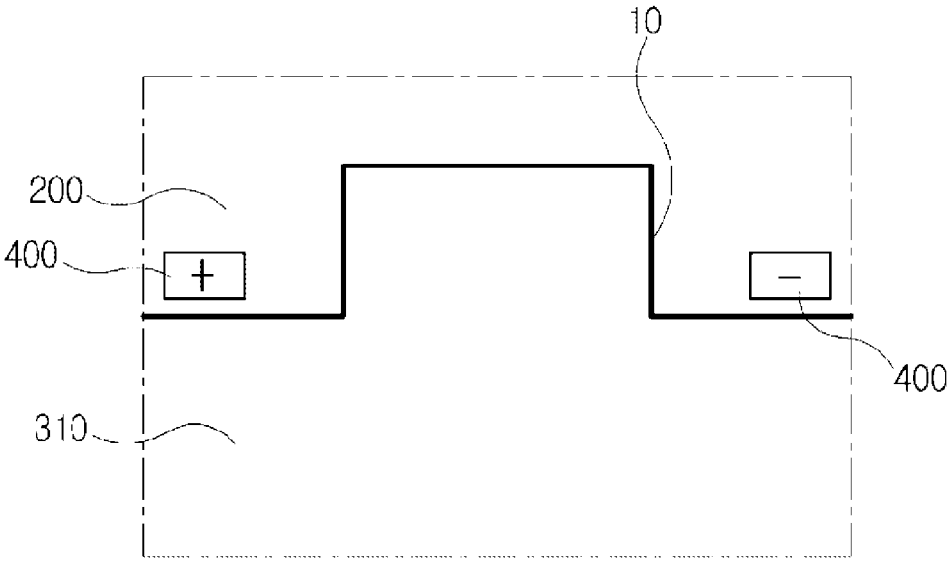
FIG. 4 is a schematic diagram illustrating a disposition structure of an electrode in accordance with a second embodiment of the present invention.

FIG. 4 is a schematic diagram illustrating a disposition structure of an electrode in accordance with a second embodiment of the present invention, in which for convenience of explanation, only the relative positions of the material and the electrode pairs are illustrated.

The second embodiment of the present invention is substantially the same as the configuration of the first embodiment of the present invention described with reference to FIGS. 2 and 3, but has a difference from the configuration of the first embodiment of the present invention in that the electrode pairs are disposed in the upper die 200.

Therefore, the same components having the same functions as the first embodiment of the present invention as described above are denoted by the same reference numerals and the overlapping description thereof will be omitted.

Third Embodiment

Figure 5:
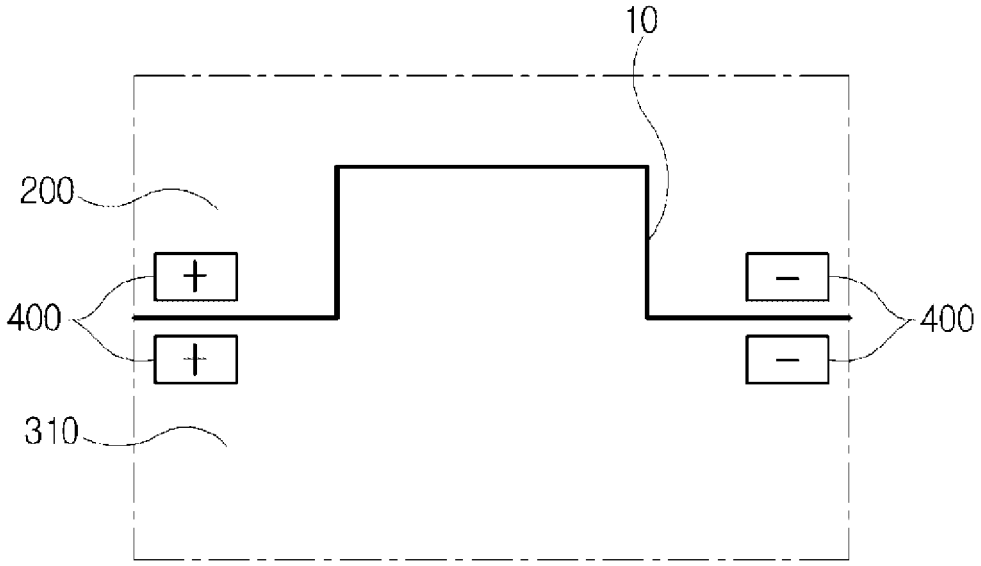
FIG. 5 is a schematic diagram illustrating a disposition structure of an electrode in accordance with a third embodiment of the present invention.

FIG. 5 is a schematic diagram illustrating a disposition structure of an electrode in accordance with a third embodiment of the present invention, in which for convenience of explanation, only the relative positions of the material and the electrode pairs are illustrated.

In accordance with the third embodiment of the present invention, both of the upper die 200 and the lower die 300 are each provided with the electrode pairs.

That is, the electrodes 400 having first polarity are disposed in the upper die 200 and the blank holder 310 along one edge in the width direction of the material 10 and the electrodes 400 having second polarity are disposed in the upper die 200 and the blank holder 310 along the other edge in the width direction of the material 10.

In this case, the electrodes 400 which are disposed in the upper holder 200 and the blank holder 310 to face each other in a thickness direction of the material have the same polarities. In this case, a flow of current in the thickness direction of the material 10 is prevented and thus a current density flowing in the width direction of the material 10 may be improved.

Fourth Embodiment

Figure 6:
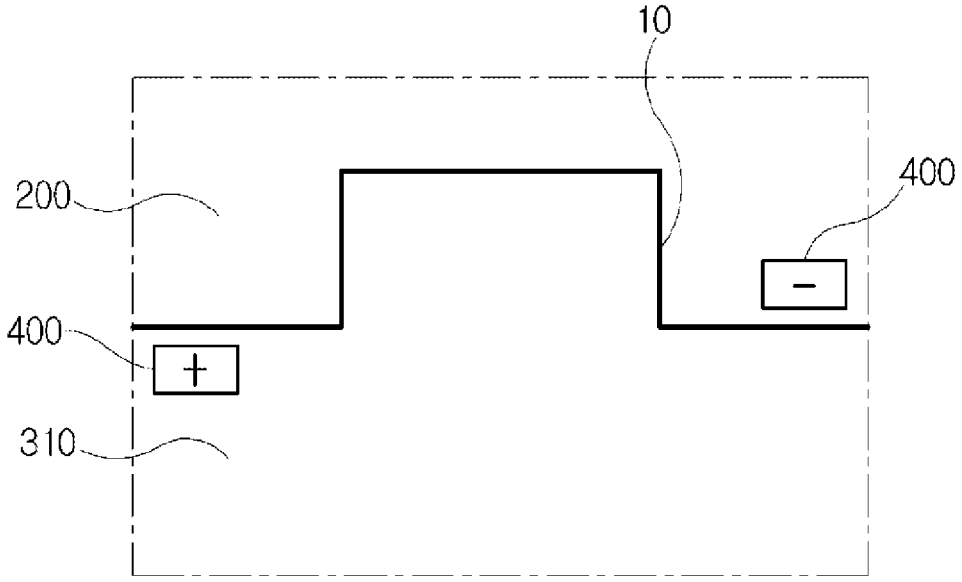
FIG. 6 is a schematic diagram illustrating a disposition structure of an electrode in accordance with a fourth embodiment of the present invention.

FIG. 6 is a schematic diagram illustrating a disposition structure of an electrode in accordance with a fourth embodiment of the present invention, in which for convenience of explanation, only the relative positions of the material and the electrode pairs are illustrated.

In accordance with the fourth embodiment of the present invention, one side of the upper die 200 and the other side of the lower die 300 are each provided with the electrodes 400 to form the electrode pairs which face each other.

That is, the electrode 400 having the first polarity is disposed in the blank holder 310 along one edge in the width direction of the material 10 and the electrode 400 having the second polarity is disposed in the upper die 200 along the other edge in the width direction of the material 10.

In this case, the material 10 may be applied with a current in the thickness direction and the width direction and the entire area of the material 10 may be uniformly applied with a current.

Fifth Embodiment

Figure 7:
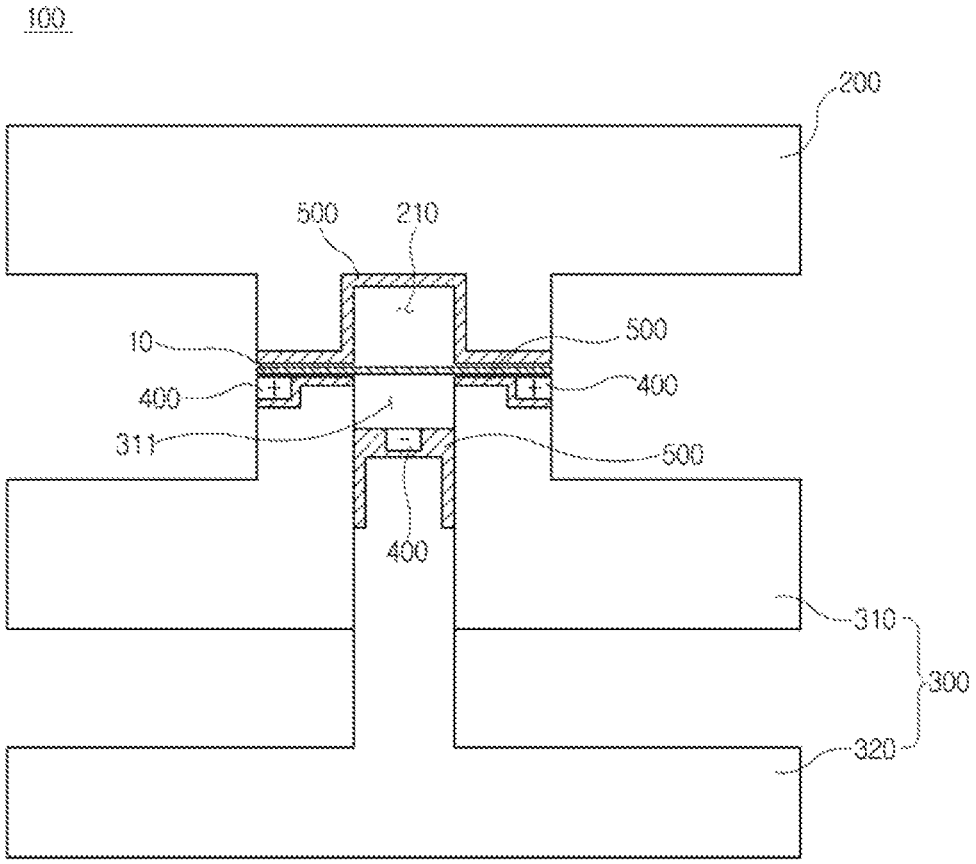
FIG. 7 is a schematic diagram of a press die for electrically assisted manufacturing in accordance with a fifth embodiment of the present invention.
Figure 8:
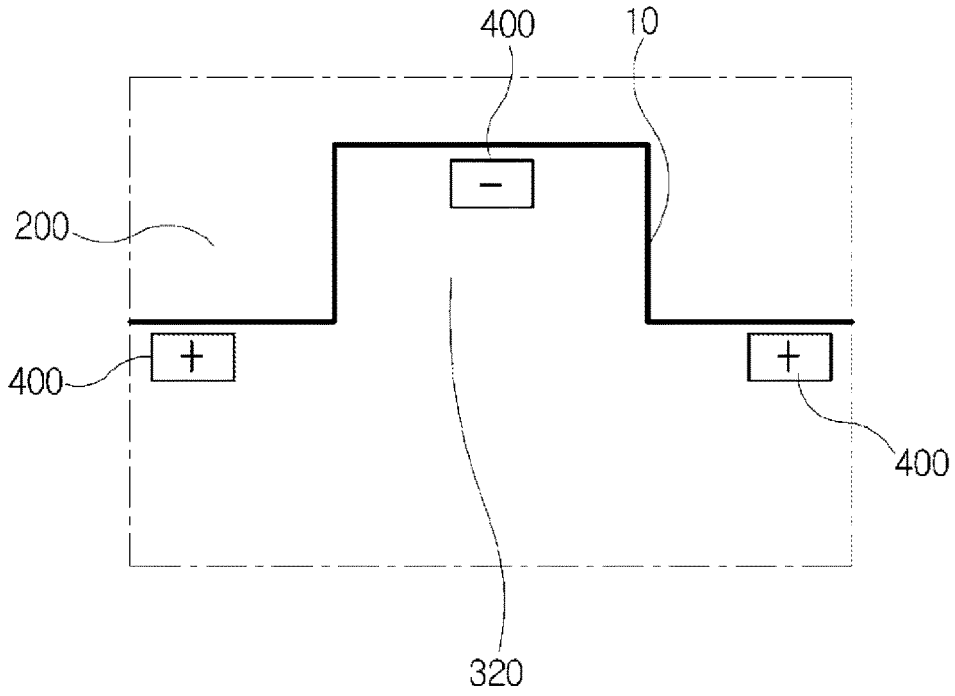
FIG. 8 is a schematic diagram illustrating a disposition structure of an electrode in accordance with the fifth embodiment of the present invention.

Referring to FIGS. 7 and 8, the electrodes 400 having the same first polarity are disposed at both edges of the blank holder 310 to face each other in the width direction of the material 10 and at least one electrode pair having the first polarity is disposed, spaced apart from each other in the length direction of the material 10.

Further, the upper end of the central portion of the punch 320 corresponding to the central portion of the material 10 is provided with the electrode 400 having the second polarity different from the electrode pair and at least one electrode 400 having the second polarity may be disposed, spaced apart from each other in the length direction of the material 10. That is, the electrodes 400 having the second polarity are disposed between the electrode pairs having the first polarity of both sides in the width direction of the material 10.

In the case of the embodiment of the present invention illustrated in FIGS. 7 and 8, the electrodes 400 having (+) polarity are disposed at both edges of the blank holder 310 along the both edges of the material 10, spaced apart from each other and the electrodes 400 having (−) polarity are disposed at the central portion of the upper end of the punch 320 along the length direction of the central portion of the material 10, spaced apart from each other.

Here, when the material 10 is formed by the press operation, a current is applied crossing a width direction of the material 10 to be applied to the entire area of the material 10 and in accordance with the embodiment of the present invention illustrated in FIGS. 7 and 8, a current is applied from the (+) electrode 400 disposed at both edges of the material 10 to the (−) electrode 400 contacting the central portion of the material 10.

Further, the electrode 400 having second polarity may be disposed at the central portion of an area in which the material 10 is relatively larger deformed than the surrounding area at the time of forming A distance between the electrode pairs having the first polarity is equal to a distance between the electrodes 400 having the second polarity and when the electrode 400 having the second polarity is biased to any one of the electrode pairs having the first polarity, the current density thereof is relatively higher and thus the flow stress inside the material 10 is likely to be non-uniformly distributed.

Meanwhile, as the material approaches the electrodes 400, the current density is high, such that the electrodes 400 are adjacently disposed to a portion at which a stress is concentrated in the material 10, that is, a portion at which cracks or wrinkles are expected to be generated at the time of press forming.

Sixth Embodiment

Figure 9:
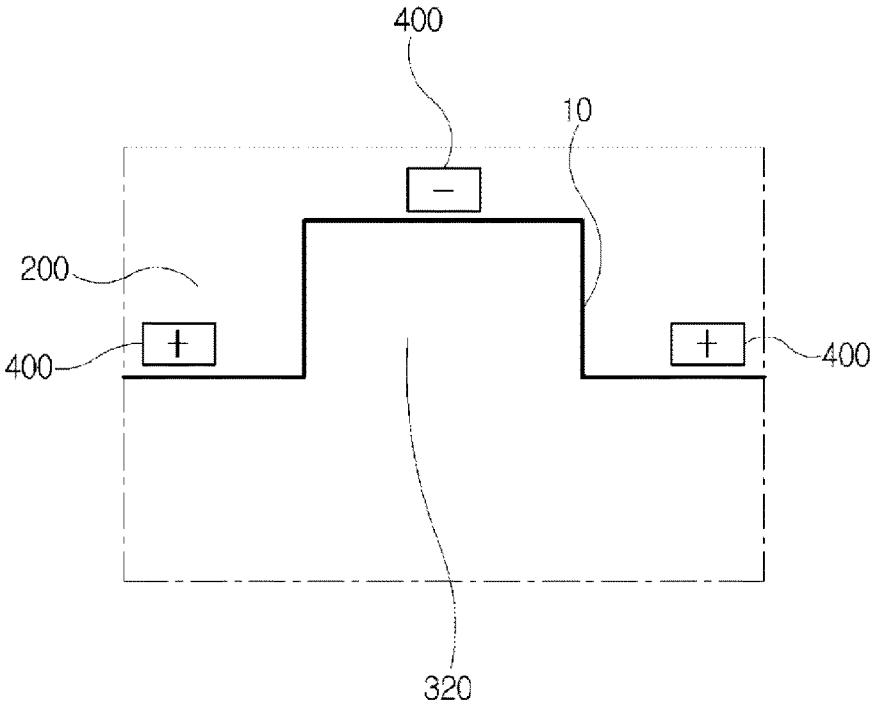
FIG. 9 is a schematic diagram illustrating a disposition structure of an electrode in accordance with a sixth embodiment of the present invention.

FIG. 9 is a schematic diagram illustrating a disposition structure of an electrode in accordance with a sixth embodiment of the present invention, in which for convenience of explanation, only the relative positions of the material and the electrodes are illustrated.

The sixth embodiment of the present invention is substantially the same as the configuration of the fifth embodiment of the present invention described with reference to FIGS. 7 and 8, but has a difference from the configuration of the fifth embodiment of the present invention in that the electrodes 400 are disposed in the upper die 200.

Therefore, the same components having the same functions as the fifth embodiment of the present invention as described above are denoted by the same reference numerals and the overlapping description thereof will be omitted.

Seventh Embodiment

Figure 10:
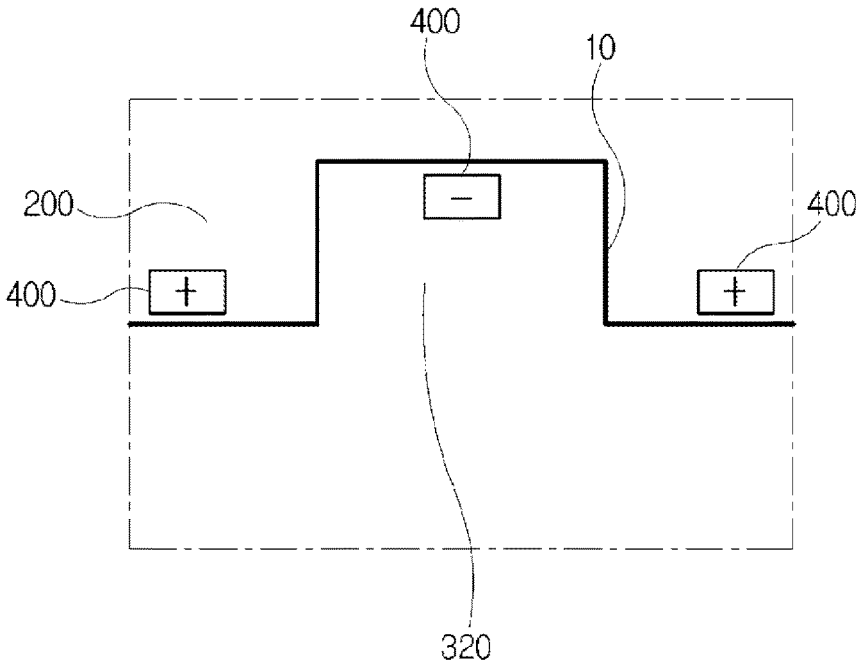
FIG. 10 is a schematic diagram illustrating a disposition structure of an electrode in accordance with a seventh embodiment of the present invention.

FIG. 10 is a schematic diagram illustrating a disposition structure of an electrode in accordance with a seventh embodiment of the present invention, in which for convenience of explanation, only the relative positions of the material and the electrode pairs are illustrated.

In accordance with the seventh embodiment of the present invention, both of the upper die 200 and the lower die 300 are each provided with the electrodes 400.

That is, the electrode pairs having the first polarity are disposed at the portions corresponding to both edges in the width direction of the material 10 in the upper die 200 and the electrode 400 having the second polarity is disposed at the central portion of the upper end of the punch 320 to correspond to the central portion of the material 10.

In this case, the material 10 may be applied with a current in the thickness direction and the width direction and the entire area of the material 10 may be uniformly applied with a current.

Eighth Embodiment

Figure 11:
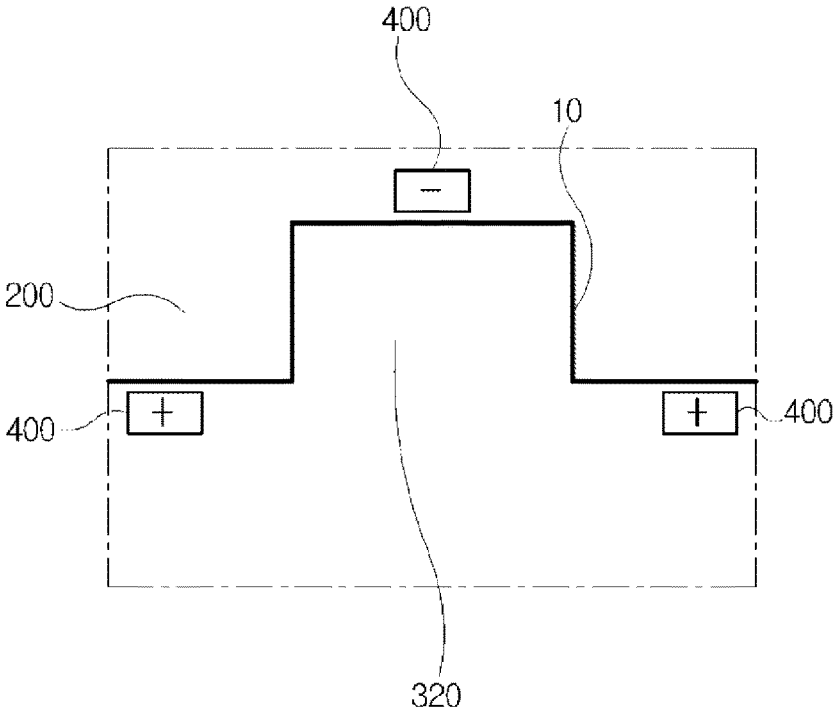
FIG. 11 is a schematic diagram illustrating a disposition structure of an electrode in accordance with an eighth embodiment of the present invention.

FIG. 11 is a schematic diagram illustrating a disposition structure of an electrode in accordance with an eighth embodiment of the present invention, in which for convenience of explanation, only the relative positions of the material and the electrode pairs are illustrated.

In accordance with the eighth embodiment of the present invention, both of the upper die 200 and the lower die 300 are each provided with the electrodes 400.

In this case, the electrode pairs having the first polarity are disposed at the portions corresponding to both edges in the width direction of the material 10 in the blank holder 310 and the electrode 400 having the second polarity is disposed at the portion corresponding to the central portion of the material 10 in the upper die 200.

Similarly to the seventh embodiment of the present invention, in accordance with the eighth embodiment of the present invention, as a current is applied in the thickness and the width direction of the material 10, the entire area of the material 10 may uniformly be applied with a current.

Ninth Embodiment

Figure 12:
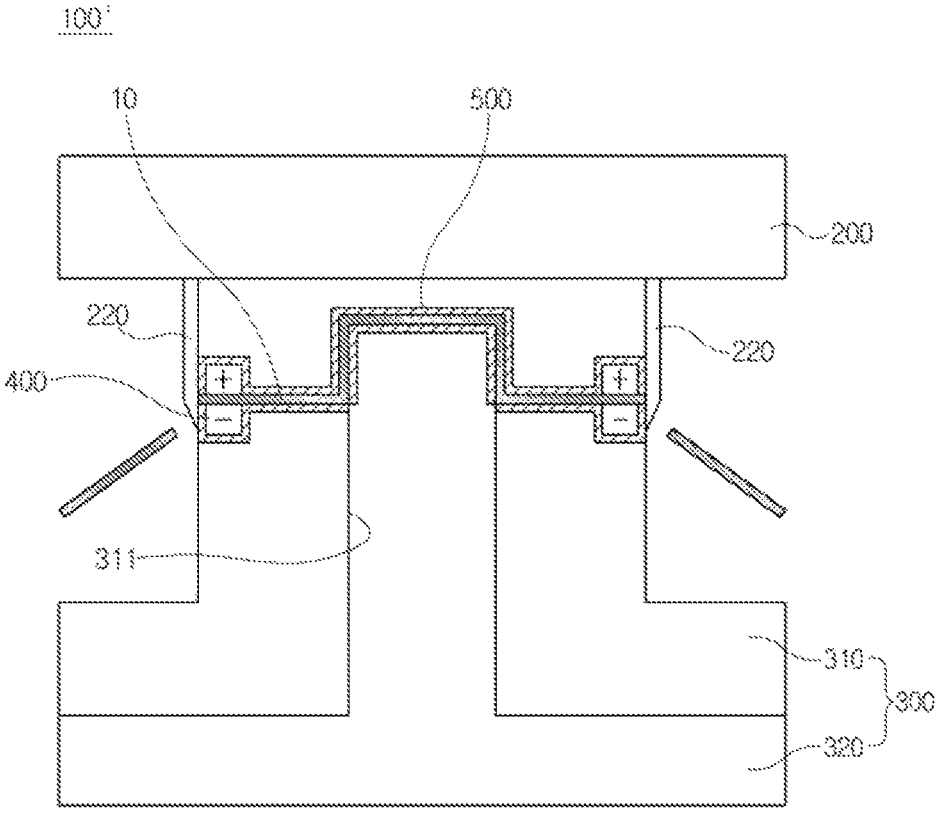
FIG. 12 is a schematic diagram of a press die for electrically assisted manufacturing in accordance with a ninth embodiment of the present invention.
Figure 13:
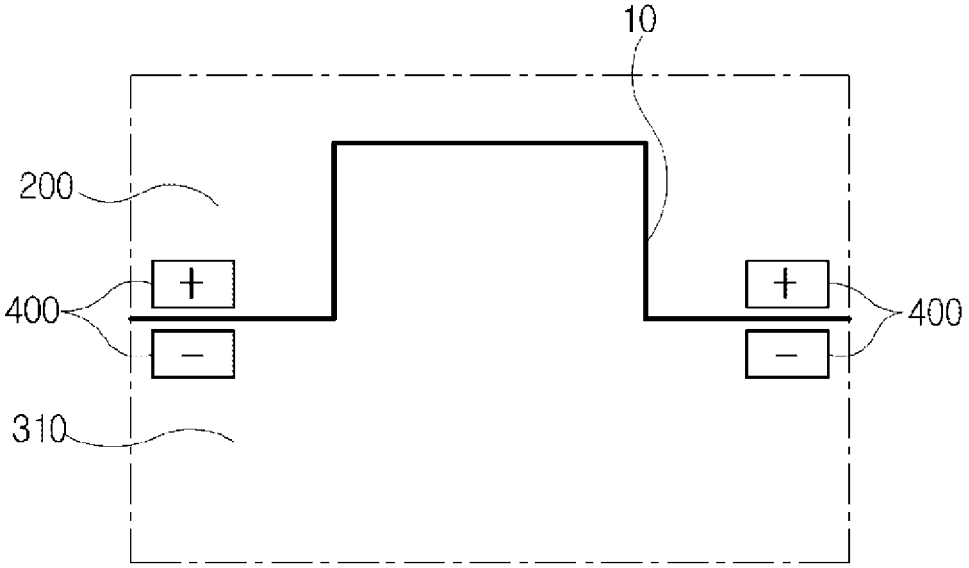
FIG. 13 is a schematic diagram illustrating a disposition structure of an electrode in accordance with the ninth embodiment of the present invention.

FIG. 12 is a schematic diagram of a press die for electrically assisted manufacturing in accordance with a ninth embodiment of the present invention and FIG. 13 is a schematic diagram illustrating a disposition structure of an electrode in accordance with the ninth embodiment of the present invention.

The aforementioned fifth to eighth embodiments of the present invention relate to the example of performing the plastic working on the material 10 using electrically assisted press manufacturing, but the ninth embodiment of the present invention relates to electrically assisted trim manufacturing.

To this end, according to a press die 100' for electrically assisted manufacturing in accordance with the embodiment of the present invention, as illustrated in FIG. 12, both sides of the upper die 200 are provided with trim cutters 220.

In this case, the trim cutter 220 may be configured to cut both edges of the material 10 while the upper die 200 moves downwardly and only the trim cutter 220 may be configured to move downwardly independent of the upper die 200. Further, to prevent the material 10 from moving at the time of the trim operation, the trim cutter 220 may be provided with a pressing pad (not illustrated) which presses the upper portion of the material 10 at one side of the trim cutter 220.

Unlike the aforementioned first to eighth embodiments of the present invention, in accordance with the ninth embodiment of the present invention, the portions corresponding to both edges in the width direction of the material 10 in the upper die 200 is provided with the electrodes 400 having the first polarity and the portions corresponding to both edges in the width direction of the material 10 in the blank holder 310 are provided with the electrodes 400 having the second polarity. That is, the central portion in the width direction of the material 10 is not provided with the electrode 400.

In this case, the electrode 400 having the first polarity which is disposed in the upper die 200 and the electrode 400 having the second polarity which is disposed in the blank holder 310 are disposed to face each other in the thickness direction of the material 10 and due to the insulating coating part 500 surrounding each electrode 400, a current is intensively applied around the electrode 400 having the first polarity and the electrode 400 having the second polarity which are adjacently to each other in the thickness direction of the material 10 at the edge portion of the material 10 which is subjected to the trim forming.

Meanwhile, when the die 100' is configured so that only the trim cutter 200 may move downwardly independent of the upper die 200, immediately after the electrically assisted press forming described in the fifth to eighth embodiments of the present invention, the electrically assisted trim forming described in the ninth embodiment of the present invention may be continuously performed without the movement of the forming body or the replacement of the die. That is, after the electrically assisted manufacturing of the material 10 is performed by the elevation of the upper die 200 and the punch 320, the trim cutter 220 moves downwardly and thus the electrically assisted trim manufacturing may be continuously performed.

However, the electric conduction at the time of the electrically assisted press manufacturing may be mainly formed in the width direction of the material 10, while the electric conduction may be mainly formed in the thickness direction of the material 10 at the time of the electrically assisted trim forming, and therefore the current applied to each electrode 400 according to the forming process may be controlled by the controller to adjust the electric conduction direction.

Further, for the purpose of only the electrically assisted trim forming, the lower die 300 may be configured of only the blank holder 310 in a block form, without the separate punch 320 for the electrically assisted press forming.

As described above, in accordance with the embodiment of the present invention, the appropriate electrode disposition structure to be able to maximize the electroplasticity effect according to the forming process such as the press forming or the trim forming of the material 10, or the like may be selected, which is applied to the actual production process of products, thereby preventing the unnecessary energy from wasting and improving the productivity.

In accordance with the embodiments of the present invention, the disposition structure of the electrode suitable for the electrically assisted manufacturing may be provided to maximize the electroplasticity effect and prevent the unnecessary energy from wasting at the time of the electrically assisted manufacturing.

Further, the electrode may be disposed at the insulating coating part which is formed in the contact area between the die and the material to prevent the current applied to the material from leaking.

In addition, the insulating coating part and the electrode may be replaceably mounted and thus may be used to be easily replaced at the time of the occurrence of damage, thereby saving the maintenance cost.

While the present invention has been described with respect to the specific embodiments, it will be apparent to those skilled in the art that various changes and modifications may be made without departing from the spirit and scope of the invention as defined in the following claims.

What is claimed is:

1. A press die for electrically assisted manufacturing performing forming at a lower temperature than hot working by using an electroplasticity effect that a flow stress inside a material is reduced when a current is applied to the material, the press die for electrically assisted manufacturing comprising:

an upper die and a lower die configured to be disposed above and below the material, respectively;

at least one electrode pair configured to be disposed in the upper die and the lower die;

a plurality of insulating parts disposed between the upper die and the material, and between the lower die and the material, the insulating parts comprising a base part and a surface-coating part coated on a surface of the base part with an insulating coating material to prevent leakage of a supplied current from the material to the upper die and the lower die, wherein the insulating parts are detachably coupled with the upper die and the lower die as separate components and are not surface coated on the upper die or the lower die; and a trim cutter configured to be disposed in the upper die and cut both edges in the width direction of the material, wherein the lower die comprises a blank holder with a guide hole, and a punch vertically movable relative to the blank holder in the guide hole, wherein the electrode pair is disposed so that circumferences of the electrodes of the electrode pair are enclosed within the insulating parts, and the electrode pair is replaceably coupled with the insulating parts, wherein the plurality of insulating parts comprises a first insulating part manufactured separately from the upper die and detachably coupled with a lower end of the upper die, a second insulating part manufactured separately from the blank holder and detachably coupled with an upper end of the blank holder, and a third insulating part manufactured separately from the punch and detachably coupled with an upper end of the punch, wherein, the electrode pair is configured so that the electrodes of the electrode pair have the same polarity in a width direction of the material, the upper die is provided with electrodes of one of the electrode pairs having a first polarity along both edges in a width direction of the material, and the lower die is provided with electrodes of the other of the electrode pairs having a second polarity facing the electrode having the first polarity along both edges in the width direction of the material.

2. The press die for electrically assisted manufacturing according to claim 1, wherein the material is encompassed by the insulating parts in the width direction of the material for preventing the supplied current to the material from leaking to the upper die and the lower die through the material.

3. The press die for electrically assisted manufacturing according to claim 1, wherein the first insulating part is configured to be detached from the upper die and replaced when the first insulating part is damaged.

4. The press die for electrically assisted manufacturing according to claim 1, wherein the second insulating part is configured to be detached from the blank holder and replaced when the second insulating part is damaged.

5. The press die for electrically assisted manufacturing according to claim 1, wherein the third insulating part is configured to be detached from the punch and replaced when the third insulating part is damaged.

6. The press die for electrically assisted manufacturing according to claim 1, wherein the electrode pair is configured to be detached from the insulating parts and replaced when the electrode pair is damaged.

* * * * *